US011217146B2

(12) United States Patent
Zhang et al.

(10) Patent No.: US 11,217,146 B2
(45) Date of Patent: Jan. 4, 2022

(54) GRAY-LEVEL COMPENSATION METHOD AND APPARATUS, DISPLAY DEVICE AND COMPUTER STORAGE MEDIUM

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Chang Zhang, Beijing (CN); Tairong Kim, Beijing (CN); Shanfu Jiang, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 124 days.

(21) Appl. No.: 16/611,874

(22) PCT Filed: Feb. 22, 2019

(86) PCT No.: PCT/CN2019/075907
§ 371 (c)(1),
(2) Date: Nov. 8, 2019

(87) PCT Pub. No.: WO2019/210731
PCT Pub. Date: Nov. 7, 2019

(65) Prior Publication Data

US 2021/0150965 A1 May 20, 2021

(30) Foreign Application Priority Data

May 2, 2018 (CN) ..... 201810409629.X

(51) Int. Cl.
*G09G 3/20* (2006.01)
*G09G 3/3258* (2016.01)
*G09G 3/3208* (2016.01)

(52) U.S. Cl.
CPC ..... *G09G 3/2007* (2013.01); *G09G 3/3258* (2013.01); *G09G 2320/0233* (2013.01)

(58) Field of Classification Search
CPC ..... G09G 3/2007; G09G 3/3258; G09G 2320/0233
See application file for complete search history.

(56) References Cited

U.S. PATENT DOCUMENTS

2007/0013622 A1* 1/2007 Stoops ..... G09G 3/3611 345/84
2014/0140611 A1* 5/2014 Yasuoka ..... G06T 3/4007 382/159

(Continued)

FOREIGN PATENT DOCUMENTS

CN 104318900 A 1/2015
CN 105304052 A 2/2016

(Continued)

OTHER PUBLICATIONS

First Office Action for Chinese Application No. 201810409629.X, dated Jun. 9, 2020, 11 Pages.

(Continued)

*Primary Examiner* — David Tung
(74) *Attorney, Agent, or Firm* — Brooks Kushman P.C.

(57) ABSTRACT

A gray-level compensation method and apparatus, a display device and a computer storage medium are provided, which belong to the field of display technology. The method includes: acquiring an initial gray-level value of a target pixel; determining an actual luminance offset of the target pixel based on the initial gray-level value, where different initial gray-level values within a specified threshold range (Continued)

correspond to different actual luminance offsets; and performing a gray-level compensation on the target pixel based on the actual luminance offset. The actual luminance offset is determined based on the initial gray-level value of the target pixel, and since the different initial gray-level values within the specified threshold range correspond to the different actual luminance offsets, flexibility of gray-level compensation performed on the pixel is improved.

17 Claims, 6 Drawing Sheets

(56) References Cited

U.S. PATENT DOCUMENTS

| | | | | |
|---|---|---|---|---|
| 2014/0152718 | A1* | 6/2014 | Kwak | G09G 5/10 345/691 |
| 2014/0198134 | A1* | 7/2014 | Moon | G09G 5/10 345/690 |
| 2015/0070403 | A1* | 3/2015 | Kim | G09G 3/20 345/690 |
| 2016/0104408 | A1 | 4/2016 | Kim et al. | |
| 2016/0260368 | A1* | 9/2016 | Zheng | G09G 3/36 |
| 2017/0206825 | A1* | 7/2017 | Cha | G09G 3/3208 |

FOREIGN PATENT DOCUMENTS

| | | | |
|---|---|---|---|
| CN | 106531069 | A | 3/2017 |
| CN | 106991982 | A | 7/2017 |
| CN | 107342064 | A | 11/2017 |
| CN | 107799080 | A | 3/2018 |
| JP | 4103528 | B2 | 6/2008 |
| KR | 20180014333 | A | 2/2018 |

OTHER PUBLICATIONS

International Search Report and Written Opinion for Application No. PCT/CN2019/075907, dated May 23, 2019, 9 Pages.

* cited by examiner

GRAY-LEVEL COMPENSATION METHOD AND APPARATUS, DISPLAY DEVICE AND COMPUTER STORAGE MEDIUM

CROSS-REFERENCE TO RELATED APPLICATION

This application is the U.S. national phase of PCT Application No. PCT/CN2019/075907filed on Feb. 22, 2019, which claims priority to Chinese Patent Application No. 201810409629.X filed on May 2, 2018, which are incorporated herein by reference in their entireties.

TECHNICAL FIELD

The present disclosure relates to the field of display technology, in particular to a gray-level compensation method and apparatus, a display device and a computer storage medium.

BACKGROUND

With the development of display technology, organic light emitting diode (OLED), as a current-type light emitting device, is increasingly applied to high performance display product owing to its features such as self-illumination, fast response time and wide view angle. Due to properties of OLED product, gray-level compensation is required, to ensure uniformity of image display luminance.

A gray-level compensation method based on a DeMura adjustment technique is provided in the related technologies. The gray-level compensation method is achieved based on a pixel compensation algorithm and a digital to analog converter (DAC). Gray-level compensation is performed for each pixel in a display panel with the pixel compensation algorithm via the DAC.

SUMMARY

Embodiments of the present disclosure provide a gray-level compensation method and apparatus, a display device and a computer storage medium.

In an aspect, a gray-level compensation method is provided. The method includes: acquiring an initial gray-level value of a target pixel; determining an actual luminance offset of the target pixel based on the initial gray-level value, where different initial gray-level values within a specified threshold range correspond to different actual luminance offsets; and performing gray-level compensation on the target pixel based on the actual luminance offset.

Optionally, the determining the actual luminance offset of the target pixel based on the initial gray-level value includes: determining an interpolation coefficient based on the initial gray-level value; acquiring a set luminance offset of the target pixel; and determining a product of the interpolation coefficient and the set luminance offset as the actual luminance offset.

Optionally, the determining the interpolation coefficient based on the initial gray-level value includes: acquiring a positive correlation relationship between the initial gray-level value and the interpolation coefficient when the initial gray-level value is less than a first gray-level threshold; and determining the interpolation coefficient corresponding to the initial gray-level value based on the positive correlation relationship.

Optionally, the determining the interpolation coefficient based on the initial gray-level value includes: acquiring a negative correlation relationship between the initial gray-level value and the interpolation coefficient when the initial gray-level value is greater than a second gray-level threshold; and determining the interpolation coefficient corresponding to the initial gray-level value based on the negative correlation relationship.

Optionally, the determining the interpolation coefficient based on the initial gray-level value includes: determining that the interpolation coefficient is a fixed coefficient when the initial gray-level value is not less than a first gray-level threshold and not greater than a second gray-level threshold, where the second gray-level threshold is greater than the first gray-level threshold.

Optionally, the performing the gray-level compensation on the target pixel based on the actual luminance offset includes: determining an actual applied voltage of the target pixel based on a voltage compensation formula, where the actual applied voltage is for driving the target pixel to emit light, and the actual applied voltage is positively correlated to a displayed gray-level value of the target pixel; where the voltage compensation formula is $Y=a*X+\eta*b$, X denotes an initial input voltage which is a voltage corresponding to the initial gray-level value, Y denotes the actual applied voltage, a denotes a voltage gain, b denotes the set luminance offset, $\eta$ denotes the interpolation coefficient, $\eta*b$ denotes the actual luminance offset, each of a and b is a constant greater than zero, and $0\leq\eta\leq1$.

Optionally, the first gray-level threshold is 20.

Optionally, the second gray-level threshold is 235.

Optionally, the actual luminance offset is zero when the initial gray-level value is zero.

In another aspect, a gray-level compensation apparatus is provided. The apparatus includes: an acquisition module, configured to acquire an initial gray-level value of a target pixel; a determination module, configured to determine an actual luminance offset of the target pixel based on the initial gray-level value, where different initial gray-level values within a specified threshold range correspond to different actual luminance offsets; and a compensation module, configured to perform gray-level compensation on the target pixel based on the actual luminance offset.

Optionally, the determination module includes: a first determination submodule, configured to determine an interpolation coefficient based on the initial gray-level value; an acquisition submodule, configured to acquire a set luminance offset of the target pixel; and a second determination submodule, configured to determine a product of the interpolation coefficient and the set luminance offset as the actual luminance offset.

Optionally, the first determination submodule is configured to: acquire a positive correlation relationship between the initial gray-level value and the interpolation coefficient when the initial gray-level value is less than a first gray-level threshold; and determine the interpolation coefficient corresponding to the initial gray-level value based on the positive correlation relationship.

Optionally, the first determination submodule is configured to: acquire a negative correlation relationship between the initial gray-level value and the interpolation coefficient when the initial gray-level value is greater than a second gray-level threshold; and determine the interpolation coefficient corresponding to the initial gray-level value based on the negative correlation relationship.

Optionally, the first determination submodule is configured to: determine that the interpolation coefficient is a fixed coefficient when the initial gray-level value is not less than a first gray-level threshold and not greater than a second gray-level threshold, where the second gray-level threshold is greater than the first gray-level threshold.

Optionally, the compensation module is configured to: determine an actual applied voltage of the target pixel based on a voltage compensation formula, where the actual applied voltage is for driving the target pixel to emit light, and the actual applied voltage is positively correlated to a displayed gray-level value of the target pixel; where the voltage compensation formula is $Y=a*X+\eta*b$, X denotes an initial input voltage which is a voltage corresponding to the initial gray-level value, Y denotes the actual applied voltage, a denotes a voltage gain, b denotes the set luminance offset, $\eta$ denotes the interpolation coefficient, $\eta*b$ denotes the actual luminance offset, each of a and b is a constant greater than zero, and $0\leq\eta\leq1$.

Optionally, the first gray-level threshold is 20.

Optionally, the second gray-level threshold is 235.

Optionally, the actual luminance offset is zero when the initial gray-level value is zero.

In still another aspect, a display device is provided. The display device includes any one of the gray-level compensation apparatus as described in the foregoing aspect.

Optionally, the display device is an OLED display device.

In yet another aspect, a gray-level compensation apparatus is provided. The apparatus includes: a processor and a memory, where the memory is configured to store a computer program; and the processor is configured to execute the computer program stored in the memory, to implement any one of the gray-level compensation method as described in the foregoing aspect.

In a further aspect, a computer storage medium is provided, when a program stored in the computer storage medium is executed by a processor, any one of the gray-level compensation method as described in the foregoing aspect is implemented.

DETAILED DESCRIPTION

To describe the objective, the technical solutions and the advantages of the present disclosure more clearly, embodiments of the present disclosure are described in detail hereinafter with reference to the accompanying drawings.

A pixel compensation algorithm is provided in the related technologies as follows: $Y=a*X+b$, where X denotes an initial input voltage inputted to a pixel, a denotes a voltage gain, b denotes a luminance offset, each of a and b is a constant greater than zero, and Y denotes an actual applied voltage applied on the pixel.

Since each of the voltage gain a and the luminance offset b is a constant greater than zero in the pixel compensation algorithm provided by the related technologies, gray-level compensation performed on a pixel in a display panel based on the pixel compensation algorithm has poor flexibility.

Figure 1:
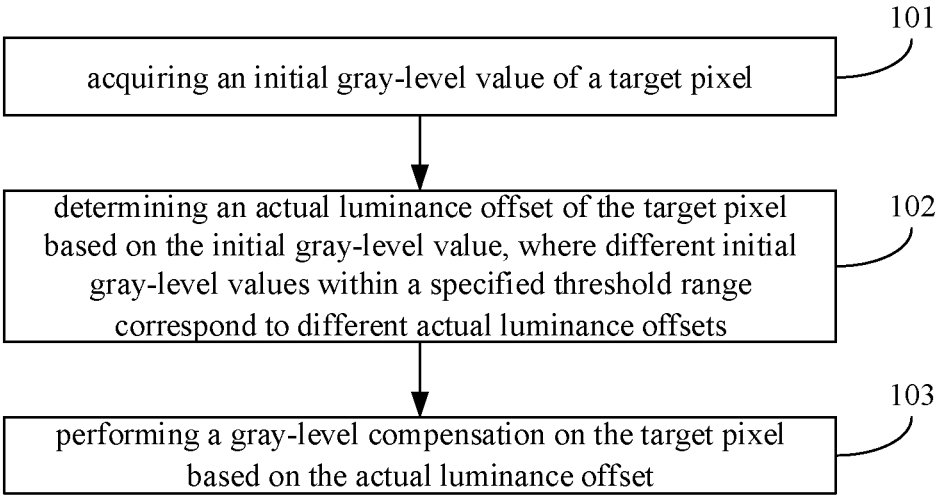
FIG. 1 is a flow diagram of a gray-level compensation method provided by embodiments of the present disclosure.

To resolve the problem in the related technologies, a gray-level compensation method is provided in embodiments of the present disclosure. FIG. 1 is a flow diagram of a gray-level compensation method provided by embodiments of the present disclosure. As shown in FIG. 1, the method may include the following work process.

In step 101, acquiring an initial gray-level value of a target pixel.

The target pixel is a pixel on a display panel. The display panel includes a plurality of pixel units, and each pixel unit includes at least one pixel.

Optionally, after acquiring a to-be-displayed image, a display terminal acquires luminance information of each pixel in the to-be-displayed image by using a charge-coupled device (CCD), and converts the luminance information of each pixel into gray-level information to obtain the initial gray-level value of the target pixel.

In step 102, determining an actual luminance offset of the target pixel based on the initial gray-level value, where different initial gray-level values within a specified threshold range correspond to different actual luminance offsets.

In step 103, performing gray-level compensation on the target pixel based on the actual luminance offset.

In summary, according to the gray-level compensation method provided by the embodiments of the present disclosure, after the initial gray-level value of the target pixel is acquired, the actual luminance offset is determined based on the initial gray-level value, and the target pixel is compensated in regard of gray-level based on the actual luminance offset. The actual luminance offset is determined based on the initial gray-level value of the target pixel and different initial gray-level values within the specified threshold range correspond to different actual luminance offsets, that is, when the initial gray-level value of a pixel varies, the actual luminance offset corresponding to the pixel may varies as well. Hence, flexibility of the pixel gray-level compensation is improved in comparison with the related technologies.

Optionally, a display panel includes a plurality of pixel units and each pixel unit includes at least one pixel. For example, each pixel unit may include a red pixel, a green pixel and a blue pixel. In an OLED display panel, each pixel includes: a thin film transistor (TFT), an anode, a light-emitting unit and a cathode. A first electrode of the TFT is connected to the anode, and a second electrode of the TFT is connected to a pixel driver circuit via a signal line. The pixel driver circuit provides an applied voltage to the second electrode via the signal line to drive a corresponding light-emitting unit to emit light. The first electrode and the second electrode are a source electrode and a drain electrode respectively, or vice versa. In the descriptions of the embodiments of the present disclosure, the case in which the first electrode is the drain electrode and the second electrode is the source electrode is taken as an example. The pixel driver circuit may include an integrated circuit (IC) chip configured to provide a data signal. The TFT in each pixel may be connected to the IC chip via the signal line, and the IC chip may also be called a source driver IC.

Optionally, by applying different source voltages on the TFT under the control of the IC chip, a multi-gray-level display of the pixel can be achieved. The greater the source voltage applied on the TFT is, the higher displayed gray-level the corresponding pixel has. The gray-level represents a degree of luminance of pixel. The higher displayed gray-level a pixel has, the greater the display luminance of the pixel is. Currently, the IC chip generally employs an 8-bit DAC. The 8-bit DAC has 256 levels of manifestations, and each level corresponds to one voltage value, that is, the 8-bit DAC may provide 256 different voltage values. Since any one of the 256 voltage values may be applied on the TFT, a gray-level ranging from 0 to 255 may be displayed by the pixel.

Figure 2:
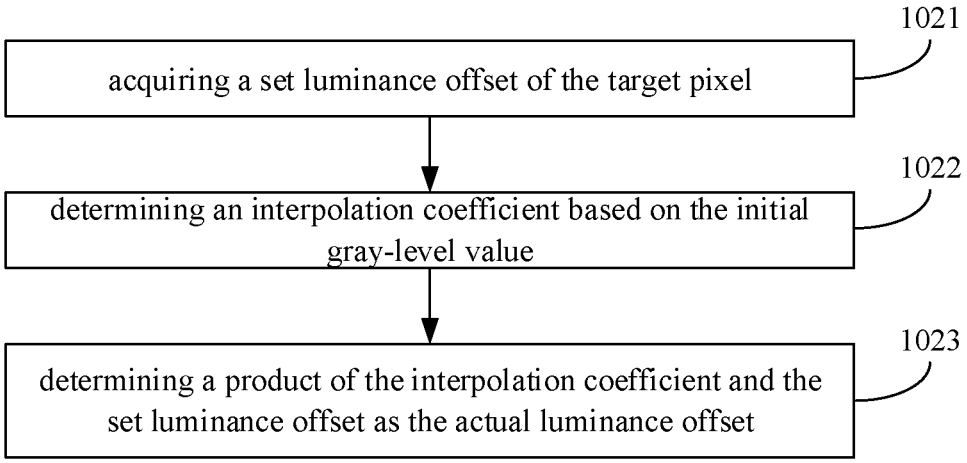
FIG. 2 is a flow diagram of a method of determining an actual luminance offset provided by embodiments of the present disclosure.

Optionally, a flow diagram of a method of determining the actual luminance offset of the target pixel based on the initial gray-level value in the step 102 may be as shown in FIG. 2, which may include the following work process.

In a step 1021, acquiring a set luminance offset of the target pixel.

The luminance offset represents a gray-level value by which a pixel is to be compensated. For example, a pixel has a gray-level value of 15, assuming the luminance offset is 5, then the pixel will have a gray-level value of 20 after gray-level compensation is performed on the pixel by using the luminance offset. In embodiments of the present disclosure, the set luminance offsets of all pixels on the display panel may be identical; or the set luminance offsets of various pixels on the display panel may be different from each other, e.g., the set luminance offset corresponding to a pixel may be set in accordance with a display position of the pixel on the display panel, which is not limited by the embodiments of the present disclosure.

Optionally, the target pixel may be any one of pixels on the display panel, or the target pixel may be a designated pixel on the display panel, which is not limited by the embodiments of the present disclosure.

In a step 1022, determining an interpolation coefficient based on the initial gray-level value.

Optionally, the interpolation coefficient has a value ranging from 0 to 1.

Since the luminance offset in the pixel compensation algorithm provided by the related technologies is a constant greater than zero, an over-compensation of a low gray-level (gray-level of 0 to 20) pixel may easily occur when gray-level compensation is performed on the low gray-level pixel by using the pixel compensation algorithm. For example, a 0-gray-level pixel has an initial input voltage of zero, and the compensation applied voltage actually applied on the pixel is greater than zero if the pixel compensation algorithm is utilized, as a result, an actual gray-level of the 0-gray-level pixel is greater than 0 after the gray-level compensation. Thus, the gray-level compensation method provided by the related technologies has a poor compensation effect.

In embodiments of the present disclosure, the interpolation coefficient may be determined based on the initial gray-level value of the target pixel. For example, when the initial gray-level value of the target pixel is 0, it may be determined that the interpolation coefficient for a set pixel offset corresponding to the target pixel is 0. Then it can be ensured that the gray-level value of the target pixel remains 0, after gray-level compensation is performed on the target pixel. Thus, the gray-level compensation method provided by the embodiments of the present disclosure can ensure gray-level compensation effect for different pixels on the display panel.

In an embodiment of the present disclosure, a positive correlation relationship between the initial gray-level value and the interpolation coefficient is acquired when the initial gray-level value is less than a first gray-level threshold; and the interpolation coefficient corresponding to the initial gray-level value is determined based on the positive correlation relationship.

Optionally, the first gray-level threshold may be 20. Since an over-compensation phenomena may occur when a pixel with a gray-level value less than 20 is compensated by using a fixed luminance offset according to the related technologies, thereby impacting the display effect of the display panel, the first gray-level threshold may be set to 20.

In embodiments of the present disclosure, when the initial gray-level value is 0, the interpolation coefficient is also 0. When the initial gray-level value is less than the first gray-level threshold, the initial gray-level value and the interpolation coefficient may meet a linear positive correlation relationship. Optionally, the value of the interpolation coefficient may change continuously as the initial gray-level value changes. As the initial gray-level value increases from 0 to the first gray-level threshold, the value of the interpolation coefficient also increases from 0 to a maximum value.

In another embodiment of the present disclosure, a negative correlation relationship between the initial gray-level value and the interpolation coefficient is acquired when the initial gray-level value is greater than a second gray-level threshold; and the interpolation coefficient corresponding to the initial gray-level value is determined based on the negative correlation relationship.

Optionally, the second gray-level threshold may be 235 when the displayed gray-level value of the target pixel ranges from 0 to 255.

For example, when the initial gray-level value is 255, the interpolation coefficient may be 0. When the initial gray-level value is greater than the second gray-level threshold, the initial gray-level value and the interpolation coefficient may meet a linear negative correlation relationship. Optionally, the value of the interpolation coefficient may change continuously as the initial gray-level value changes. As the initial gray-level value increases from the second gray-level threshold to 255 (maximum gray-level value), the interpolation coefficient decreases from a maximum value to 0.

It is noted that, since the maximum displayed gray-level that can be achieved by an 8-bit DAC is 255, when a fixed luminance offset is used to perform gray-level compensation on pixels with large gray-level values, it may be caused that all the compensated pixels have a gray-level value of 255. For example, if gray-level compensation using a fixed luminance offset of 10 is performed on the pixels with gray-level values ranging from 245 to 255, the resultant gray-level values of the pixels are all 255, leading to a reduction of levels of gray-scale and impacting the level of detail of displayed image. The more levels of gray-scale there are, the higher the level of detail of displayed image is. By determining the interpolation coefficient using the method provided by the embodiments of the present disclosure, it can be ensured that there is no reduction in levels of gray-scale after gray-level compensation is performed on the high gray-level pixels, thereby improving the level of detail of displayed image.

In yet another embodiment of the present disclosure, it is determined that the interpolation coefficient is a fixed coefficient, when the initial gray-level value is not less than a first gray-level threshold and not greater than a second gray-level threshold, where the second gray-level threshold is greater than the first gray-level threshold.

Optionally, the first gray-level threshold may be 20; the second gray-level threshold may be 235 when the displayed gray-level value of the target pixel ranges from 0 to 255.

It is noted that, when the initial gray-level value is not less than the first gray-level threshold and not greater than the second gray-level threshold, the interpolation coefficient is a fixed coefficient; that is, when the initial gray-level value is not less than the first gray-level threshold, the value of the interpolation coefficient remains the same regardless of the initial gray-level value, and the fixed coefficient is equal to the maximum value of the interpolation coefficient.

In an exemplary embodiment of the present disclosure, the process of determining the interpolation coefficient based on the initial gray-level value includes: detecting whether the initial gray-level value is less than a first gray-level threshold; acquiring a positive correlation relationship between the initial gray-level value and the interpolation coefficient when the initial gray-level value is less than the first gray-level threshold; and determining the interpolation coefficient corresponding to the initial gray-level value based on the positive correlation relationship. When the initial gray-level value is not less than the first gray-level threshold, it is determined that the interpolation coefficient is a fixed coefficient. The positive correlation relationship between the initial gray-level value and the interpolation coefficient may be expressed with a formula.

Figure 3:
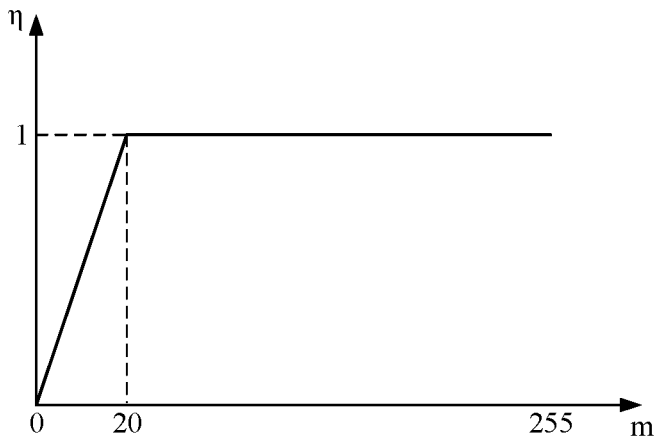
FIG. 3 is a schematic diagram of a relationship between an interpolation coefficient and an initial gray-level value provided by embodiments of the present disclosure.

For example, assuming the first gray-level threshold is 20 and the maximum value of the interpolation coefficient (i.e., the fixed coefficient) is 1, the relationship between the interpolation coefficient and the initial gray-level value may be as shown in FIG. 3, where the abscissa denotes the initial gray-level value m, and the ordinate denotes the interpolation coefficient η. The interpolation coefficient η and the initial gray-level value m satisfy the first formula:

$$\eta = \begin{cases} \frac{1}{20} \times m, & 0 \le m < 20 \\ 1, & 20 \le m \le 255 \end{cases}.$$

In another exemplary embodiment of the present disclosure, the process of determining the interpolation coefficient based on the initial gray-level value includes: detecting whether the initial gray-level value is greater than a second gray-level threshold; acquiring a negative correlation relationship between the initial gray-level value and the interpolation coefficient when the initial gray-level value is greater than the second gray-level threshold; and determining the interpolation coefficient corresponding to the initial gray-level value based on the negative correlation relationship. When the initial gray-level value is not greater than the second gray-level threshold, it is determined that the interpolation coefficient is a fixed coefficient. The negative correlation relationship between the initial gray-level value and the interpolation coefficient may be expressed with a formula.

Figure 4:
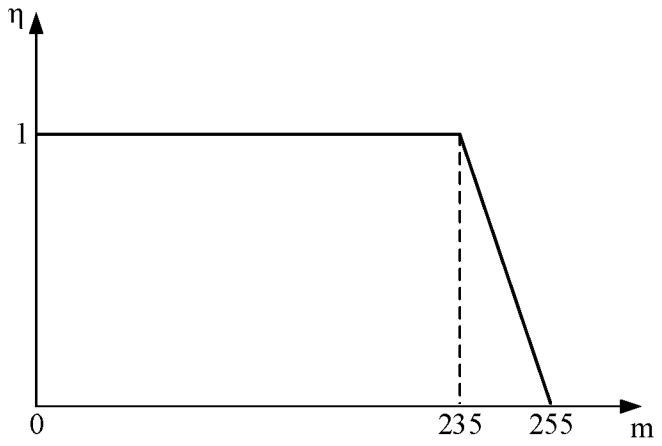
FIG. 4 is a schematic diagram of another relationship between an interpolation coefficient and an initial gray-level value provided by embodiments of the present disclosure.

For example, assuming the second gray-level threshold is 235 and the maximum value of the interpolation coefficient (i.e., the fixed coefficient) is 1, the relationship between the interpolation coefficient and the initial gray-level value may be as shown in FIG. 4, where the abscissa denotes the initial gray-level value m, and the ordinate denotes the interpolation coefficient η. The interpolation coefficient η and the initial gray-level value m satisfy the first formula:

$$\eta = \begin{cases} 1, & 0 \le m \le 235 \\ -\frac{1}{20}m + \frac{255}{20}, & 235 < m \le 255 \end{cases}.$$

In still another exemplary embodiment of the present disclosure, the process of determining the interpolation coefficient based on the initial gray-level value includes: detecting whether the initial gray-level value is less than a first gray-level threshold; determining that the initial gray-level value and the interpolation coefficient meet a positive correlation relationship when the initial gray-level value is less than the first gray-level threshold; and determining the interpolation coefficient corresponding to the initial gray-level value based on the positive correlation relationship; when the initial gray-level value is not less than the first gray-level threshold, detecting whether the initial gray-level value is greater than a second gray-level threshold, where the second gray-level threshold is greater than the first gray-level threshold; determining that the initial gray-level value and the interpolation coefficient meet a negative correlation relationship when the initial gray-level value is greater than the second gray-level threshold; and determining the interpolation coefficient corresponding to the initial gray-level value based on the negative correlation relationship. When the initial gray-level value is not greater than the second gray-level threshold and not less than the first gray-level threshold, it is determined that the interpolation coefficient is a fixed coefficient. Each of the positive correlation relationship and the negative correlation relationship between the initial gray-level value and the interpolation coefficient may be expressed with a formula.

In the exemplary embodiment, the step of detecting whether the initial gray-level value is greater than the second gray-level threshold may be performed first, and when the initial gray-level value is not greater than the second gray-level threshold, the step of detecting whether the initial gray-level value is less than the first gray-level threshold may be performed. The order of performing these detecting steps is not limited by the embodiments of the present disclosure.

Figure 5:
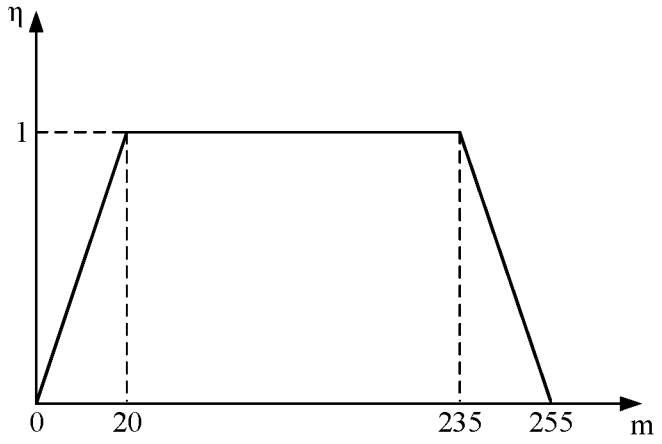
FIG. 5 is a schematic diagram of still another relationship between an interpolation coefficient and an initial gray-level value provided by embodiments of the present disclosure.

For example, assuming the first gray-level threshold is 20, the second gray-level threshold is 235 and the maximum value of the interpolation coefficient (i.e., the fixed coefficient) is 1, the relationship between the interpolation coefficient and the initial gray-level value may be as shown in FIG. 5, where the abscissa denotes the initial gray-level value m, and the ordinate denotes the interpolation coefficient η. The interpolation coefficient η and the initial gray-level value m satisfy the second formula:

$$\eta = \begin{cases} \frac{1}{20} \times m, 0 \le m < 20 \\ 1, 20 \le m \le 235 \\ -\frac{1}{20}m + \frac{255}{20}, 235 < m \le 255 \end{cases}.$$

In a step 1023, determining a product of the interpolation coefficient and the set luminance offset as the actual luminance offset.

Referring to the description with respect to the step 1022, when the initial gray-level value is 0, the interpolation coefficient is 0, and the actual luminance offset is also 0. That is, when the initial gray-level value is 0, by masking the offset for the target pixel, the pixel with a gray-level of 0 still has a displayed gray-level of 0 after the gray-level compensation, thereby improving the effect of pixel gray-level compensation.

Accordingly, the step 103 may be implemented in the following process: determining an actual applied voltage of the target pixel by using a voltage compensation formula, where the actual applied voltage is for driving the target pixel to emit light, and the actual applied voltage is positively correlated to a displayed gray-level value of the target pixel; where the voltage compensation formula is Y=a*X+η*b, X denotes an initial input voltage which is a voltage corresponding to the initial gray-level value, i.e., when the initial input voltage is applied on the target pixel, the displayed gray-level value of the target pixel is equal to the initial gray-level value, Y denotes the actual applied voltage, a denotes a voltage gain, b denotes the set luminance offset, η denotes the interpolation coefficient, η*b denotes the actual luminance offset, each of a and b is a constant greater than zero, and 0≤η≤1.

Optionally, the actual applied voltage may be a voltage applied to the source electrode of the TFT. Since the displayed gray-level of the pixel is linearly positively correlated to the voltage applied to the source electrode, the foregoing voltage compensation formula may be in effect regarded as a gray-level compensation formula, as such, X denotes an initial gray-level value, a denotes a gray-level gain, and Y denotes an actual gray-level value.

Figure 6:
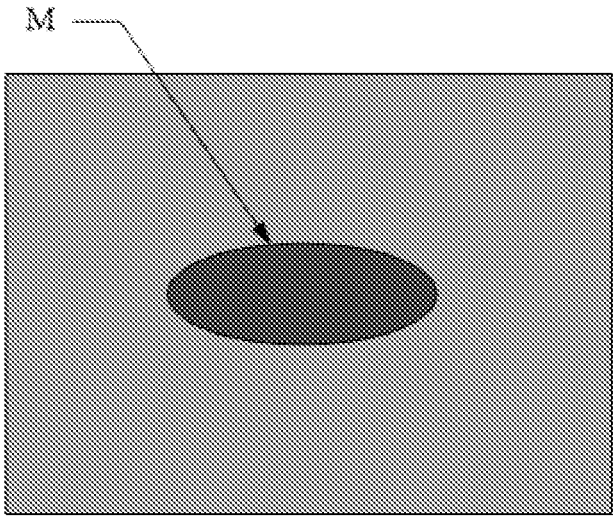
FIG. 6 is a schematic diagram of gray-scale display of a display panel before compensation provided by embodiments of the present disclosure is performed.
Figure 7:
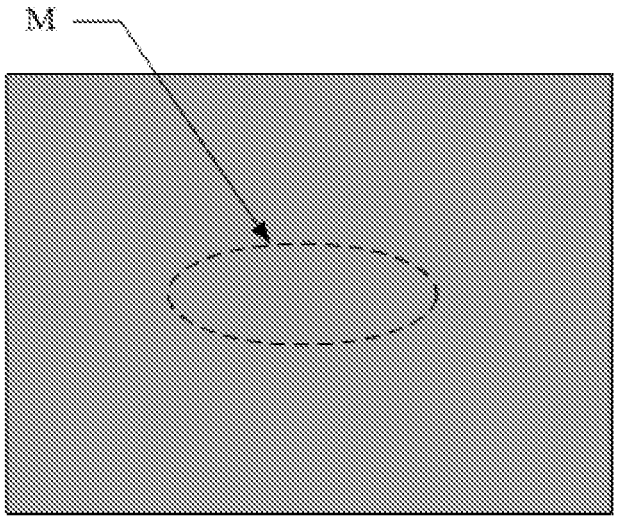
FIG. 7 is a schematic diagram of gray-scale display of a display panel after compensation provided by embodiments of the present disclosure is performed.

For example, assuming that the initial gray-level value is 10, the gray-level gain is 1, and the set luminance offset is 12, the interpolation coefficient is determined as 0.5 with reference to the foregoing first formula or second formula, then after gray-level compensation of the target pixel, the actual gray-level value is Y=1*10+0.5*12=16. FIG. 6 and FIG. 7 are respectively schematic diagrams of gray-scale display of a display panel before and after the compensation provided by embodiments of the present disclosure. In these drawings, a darker color represents a smaller gray-level value (i.e., lower luminance). Referring to FIG. 6, assume that the target pixel includes pixels in the specified area M on the display panel which have gray-level values less than those of pixels outside the specified area M, and assume that the initial gray-level values of the pixels in the specified area M are 10 and the gray-level values of pixels on the display panel apart from those in the specified area M are 16. Referring to FIG. 7, after gray-level compensation is performed on the pixels in the specified area M by using the gray-level compensation method of the embodiments of the present disclosure, the actual gray-level values of the pixels in the specified area M may be changed to 16, i.e., equal to the displayed gray-level values of other pixels on the display panel, thus ensuring the display luminance uniformity of the display panel.

Figure 8:
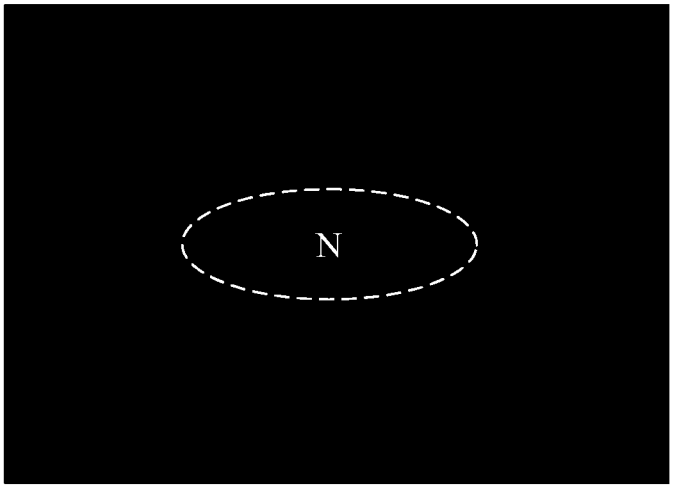
FIG. 8 is another schematic diagram of gray-scale display of a display panel before compensation provided by embodiments of the present disclosure is performed.
Figure 9:
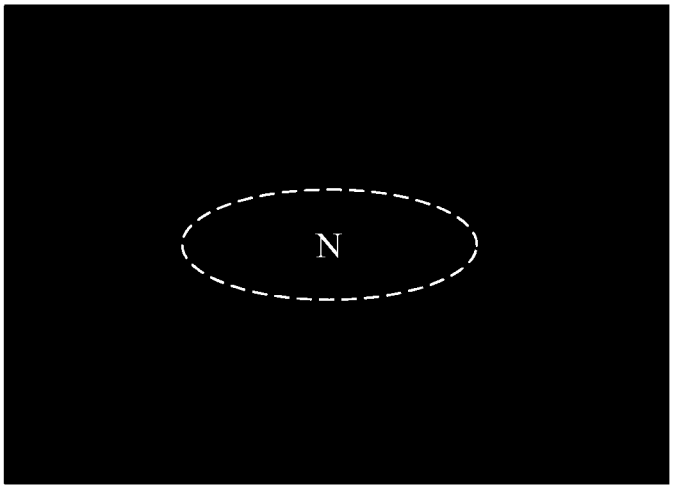
FIG. 9 is another schematic diagram of gray-scale display of a display panel after compensation provided by embodiments of the present disclosure is performed.

For another example, assuming that the initial gray-level value is 0, the gray-level gain is 1, and the set luminance offset is 12, the interpolation coefficient is determined as 0 with reference to the foregoing first formula or second formula, then after gray-level compensation of the target pixel, the actual gray-level value is Y=1*0+0*12=0. FIG. 8 and FIG. 9 are respectively other schematic diagrams of gray-level display of a display panel before and after the compensation provided by embodiments of the present disclosure. Referring to FIG. 8 and FIG. 9, assuming that the target pixel includes pixels in the specified area N, after gray-level compensation is performed on the pixels with a gray-level of 0 by using the gray-level compensation method of the embodiments of the present disclosure, the actual gray-level values of the pixels in the specified area N remain 0, thereby avoiding the over-compensation phenomena of the low gray-level pixels.

It can be seen from the two foregoing examples that, in the gray-level compensation method provided by the embodiments of the present disclosure, the actual luminance offset may be determined according to the initial gray-level value of the target pixel, thereby improving the flexibility of pixel gray-level compensation and ensuring the effect of pixel gray-level compensation.

Optionally, the foregoing step 102 may further be implemented in the following process: acquiring the actual luminance offset of the target pixel from a set correspondence based on the initial gray-level value of the target pixel and the set correspondence between the initial gray-level value and the actual luminance offset. Multiple correspondences between initial gray-level values and actual luminance offsets are stored in the set correspondence, e.g., the set correspondence may store actual luminance offset corresponding to each gray-level value of gray-levels of 0 to 255. Optionally, the set correspondence may be stored in the form of an index table.

It is noted that, the order of performing the steps of the gray-level compensation method provided by the embodiments of the present disclosure may be adjusted as needed, for example, the step 1022 may be performed prior to the step 1021. A step may be omitted or added as appropriate. Any modifications that would easily occur to those skilled in the art, without departing from the technical scope disclosed in the present disclosure, should be encompassed in the protection scope of the present disclosure. Therefore, a repeated description is omitted herein.

In summary, according to the gray-level compensation method provided by the embodiments of the present disclosure, after the initial gray-level value of the target pixel is acquired, the actual luminance offset is determined based on the initial gray-level value and the target pixel is compensated in regard of gray-level based on the actual luminance offset. Since the actual luminance offset is determined based on the initial gray-level value of the target pixel, when the initial gray-level value of a pixel varies, the luminance offset corresponding to the pixel may varies as well, and the flexibility of the pixel gray-level compensation is improved in comparison with the related technologies. In addition, in the embodiments of the present disclosure, when the initial gray-level value is less than the first gray-level threshold, the actual luminance offset is positively correlated to the initial gray-level value, e.g., when the initial gray-level value is 0, the actual luminance offset may also be 0, thereby avoiding an over-compensation of low gray-level pixel; when the initial gray-level value is greater than the second gray-level threshold, the actual luminance offset is negatively correlated to the initial gray-level value, as a result, it can be ensured that there is no reduction in levels of pixel gray-scale after gray-level compensation is performed on the high gray-level pixels, thereby improving the level of detail of displayed image. Thus, the gray-level compensation method provided by the embodiments of the present disclosure improves the effect of pixel gray-level compensation.

Figure 10:
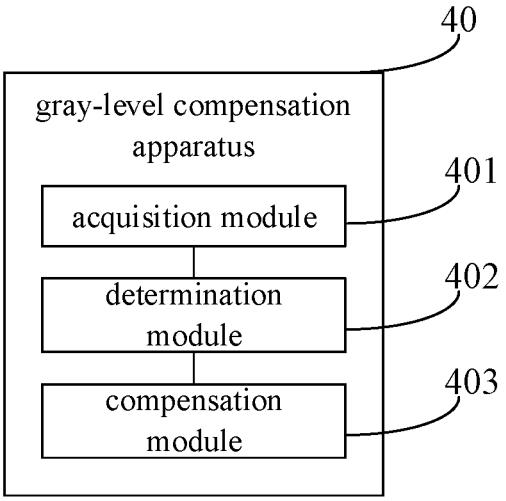
FIG. 10 is a schematic structural diagram of a gray-scale compensation apparatus provided by embodiments of the present disclosure.

FIG. 10 is a schematic structural diagram of a gray-level compensation apparatus provided by embodiments of the present disclosure. As shown in FIG. 10, the apparatus 40 may include: an acquisition module 401, configured to acquire an initial gray-level value of a target pixel, where the target pixel is a pixel on a display panel, the display panel includes a plurality of pixel units and each pixel unit includes at least one pixel; a determination module 402, configured to determine an actual luminance offset of the target pixel based on the initial gray-level value, where different initial gray-level values within a specified threshold range correspond to different actual luminance offsets; and a compensation module 403, configured to perform gray-level compensation on the target pixel based on the actual luminance offset.

In summary, according to the gray-level compensation apparatus provided by the embodiments of the present disclosure, after the initial gray-level value of the target pixel is acquired by the acquisition module, the actual luminance offset is determined by the determination module based on the initial gray-level value and the target pixel is compensated in regard of gray-level by the compensation module based on the actual luminance offset. The actual luminance offset is determined based on the initial gray-level value of the target pixel and different initial gray-level values within the specified threshold range correspond to different actual luminance offsets, that is, when the initial gray-level value of a pixel varies, the actual luminance offset corresponding to the pixel may varies as well, and the flexibility of the pixel gray-level compensation is improved in comparison with the related technologies.

Figure 11:
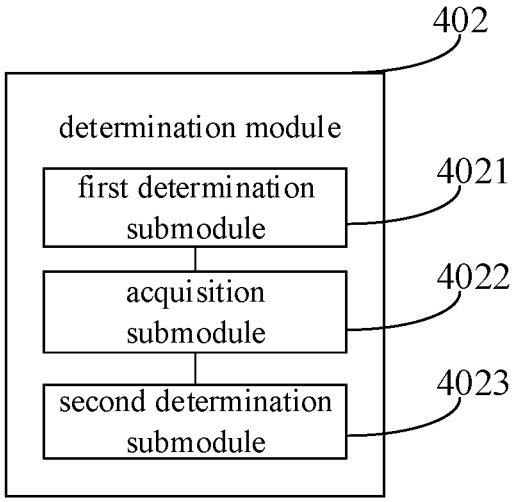
FIG. 11 is a schematic structural diagram of a determination module provided by embodiments of the present disclosure.

Optionally, as shown in FIG. 11, the determination module 402 may include: a first determination submodule 4021, configured to determine an interpolation coefficient based on the initial gray-level value; an acquisition submodule 4022, configured to acquire a set luminance offset of the target pixel; and a second determination submodule 4023, configured to determine a product of the interpolation coefficient and the set luminance offset as the actual luminance offset.

Optionally, the first determination submodule may be configured to: acquire a positive correlation relationship between the initial gray-level value and the interpolation coefficient when the initial gray-level value is less than a first gray-level threshold; and determine the interpolation coefficient corresponding to the initial gray-level value based on the positive correlation relationship.

Optionally, the first determination submodule may be configured to: acquire a negative correlation relationship between the initial gray-level value and the interpolation coefficient when the initial gray-level value is greater than a second gray-level threshold; and determine the interpolation coefficient corresponding to the initial gray-level value based on the negative correlation relationship.

Optionally, the first determination submodule may be configured to: determine that the interpolation coefficient is a fixed coefficient when the initial gray-level value is not less than a first gray-level threshold and not greater than a second gray-level threshold, where the second gray-level threshold is greater than the first gray-level threshold.

Optionally, the compensation module may be configured to: determine an actual applied voltage of the target pixel by using a voltage compensation formula, where the actual applied voltage is for driving the target pixel to emit light, and the actual applied voltage is positively correlated to a displayed gray-level value of the target pixel; where the voltage compensation formula is $Y=a*X+\eta*b$, X denotes an initial input voltage which is a voltage corresponding to the initial gray-level value, Y denotes the actual applied voltage, a denotes a voltage gain, b denotes the set luminance offset, $\eta$ denotes the interpolation coefficient, $\eta*b$ denotes the actual luminance offset, each of a and b is a constant greater than zero, and $0\leq\eta\leq1$.

Optionally, the first gray-level threshold is 20.

Optionally, the second gray-level threshold is 235.

Optionally, the actual luminance offset is zero when the initial gray-level value is zero.

In summary, according to the gray-level compensation apparatus provided by the embodiments of the present disclosure, after the initial gray-level value of the target pixel is acquired by the acquisition module, the actual luminance offset is determined by the determination module based on the initial gray-level value and the target pixel is compensated in regard of gray-level by the compensation module based on the actual luminance offset. Since the actual luminance offset is determined based on the initial gray-level value of the target pixel, when the initial gray-level value of a pixel varies, the actual luminance offset corresponding to the pixel may varies as well, and the flexibility of the pixel gray-level compensation is improved in comparison with the related technologies. In addition, in the embodiments of the present disclosure, when the initial gray-level value is less than the first gray-level threshold, the actual luminance offset is positively correlated to the initial gray-level value, e.g., when the initial gray-level value is 0, the actual luminance offset may also be 0, thereby avoiding an over-compensation of low gray-level pixel; when the initial gray-level value is greater than the second gray-level threshold, the actual luminance offset is negatively correlated to the initial gray-level value, as a result, it can be ensured that there is no reduction in levels of pixel gray-scale after gray-level compensation is performed on the high gray-level pixels, thereby improving the level of detail of displayed image. Thus, the gray-level compensation method provided by the embodiments of the present disclosure improves the effect of pixel gray-level compensation.

The specific operation modes of various modules in the apparatus of the foregoing embodiments are described in detail in the embodiments of related method, therefore a detailed description is omitted herein.

A display device is provided in embodiments of the present disclosure. The display device may include the gray-level compensation apparatus as shown in FIG. 10.

Optionally, the display device may be an OLED display device.

The display device may be any product or component provided with a display function, such as electronic paper, a cell phone, a tablet computer, a television, a display, a notebook computer, a digital picture frame, or a navigator.

In summary, according to the display device including the gray-level compensation apparatus provided by the embodiments of the present disclosure, after the initial gray-level value of the target pixel is acquired by the acquisition module, the actual luminance offset is determined by the determination module based on the initial gray-level value and the target pixel is compensated in regard of gray-level by the compensation module based on the actual luminance offset. Since the actual luminance offset is determined based on the initial gray-level value of the target pixel, when the initial gray-level value of a pixel varies, the actual luminance offset corresponding to the pixel may varies as well, and the flexibility of the pixel gray-level compensation is improved in comparison with the related technologies. In addition, in the embodiments of the present disclosure, when the initial gray-level value is less than the first gray-level threshold, the actual luminance offset is positively correlated to the initial gray-level value, e.g., when the initial gray-level value is 0, the actual luminance offset may also be 0, thereby avoiding an over-compensation of low gray-level pixel; when the initial gray-level value is greater than the second gray-level threshold, the actual luminance offset is negatively correlated to the initial gray-level value, as a result, it can be ensured that there is no reduction in levels of pixel gray-scale after gray-level compensation is performed on the high gray-level pixels, thereby improving the level of detail of displayed image. Thus, the gray-level compensation method provided by the embodiments of the present disclosure improves the effect of pixel gray-level compensation.

A gray-level compensation apparatus is provided in embodiments of the present disclosure. The gray-level compensation apparatus may be integrated on an IC chip and includes a processor and a memory, where the memory is configured to store a computer program; and the processor is configured to execute the computer program stored in the memory, to implement the gray-level compensation method as described in any one of the method embodiments.

Figure 12:
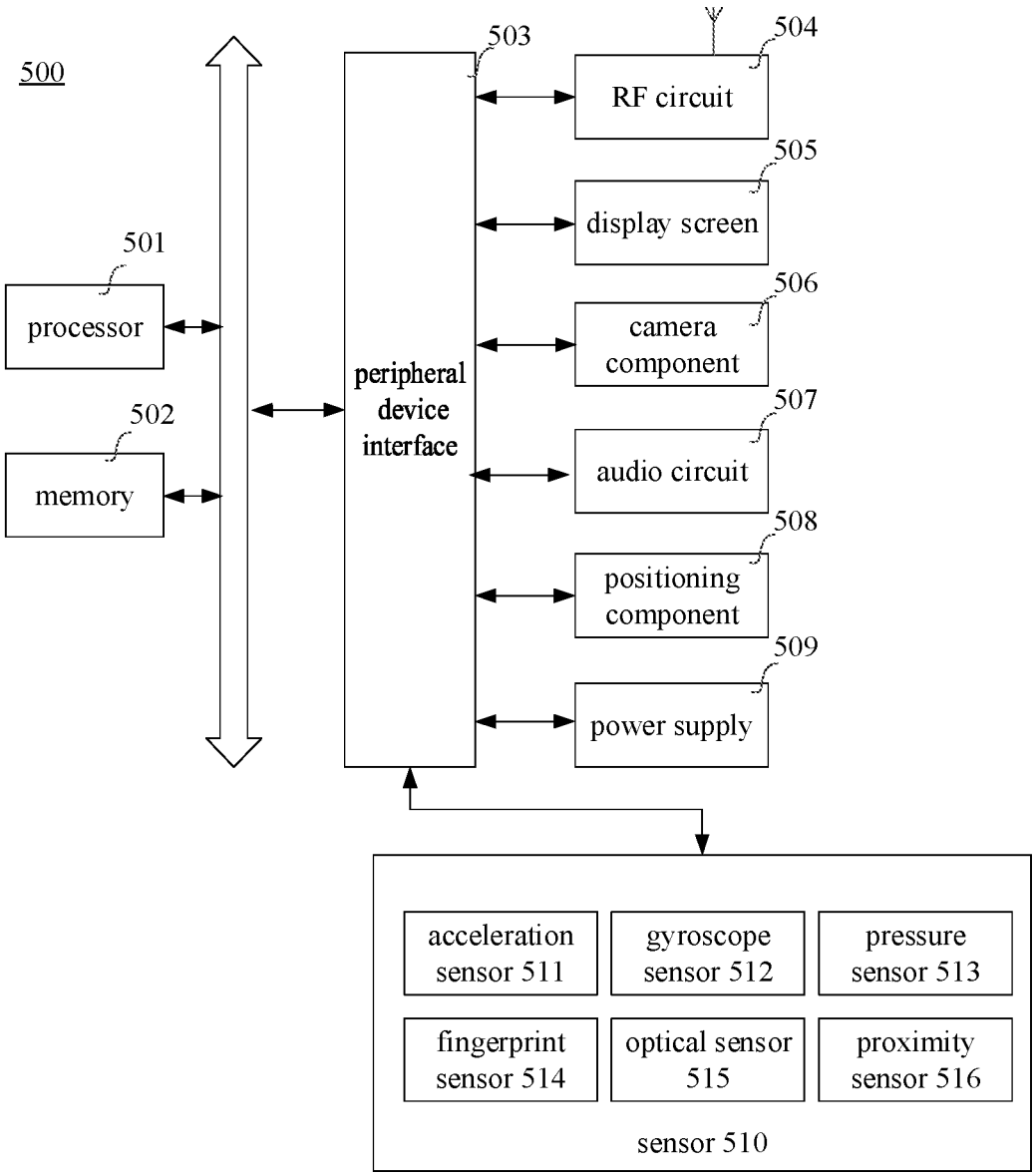
FIG. 12 is a block diagram of a gray-level compensation apparatus provided by embodiments of the present disclosure.

FIG. 12 is a block diagram of a gray-level compensation apparatus provided by embodiments of the present disclosure. The gray-level compensation apparatus may be applicable to a display terminal. The display terminal 500 may be a portable mobile terminal, such as a smart phone, a tablet computer, a moving picture experts group audio layer III (MP3) player, a moving picture experts group audio layer IV (MP4) player, a notebook computer or desktop computer. The display terminal 500 may also be referred to as user equipment, portable terminal, laptop terminal, desktop terminal or the like.

Generally, the display terminal 500 includes a processor 501 and a memory 502.

The processor 501 may include one or more processor cores, such as a 4-core processor or an 8-core processor. The processor 501 may be implemented in at least one hardware form of: a digital signal processor (DSP), a field-programmable gate array (FPGA), or a programmable logic array (PLA). The processor 501 may include a main processor and a coprocessor. The main processor, also referred to as central processing unit (CPU), is a processor configured to process data in a wakeup state; and the coprocessor is a low power consumption processor configured to process data in a standby state. In some embodiments, the processor 501 may be integrated with a graphics processing unit (GPU), and the GPU is responsible for rendering and drawing content to be displayed by a display screen. In some embodiments, the processor 501 may include an artificial intelligence (AI) processor, and the AI processor is configured to handle calculating operations related to machine learning.

The memory 502 may include one or more computer readable storage media. The computer readable storage medium may be non-transient. The memory 502 may include a high-speed random access memory, and a non-volatile memory, such as one or more magnetic disk storage devices or flash memory storage devices. In some embodiments, a non-transient computer readable storage medium in the memory 502 is configured to store at least one instruction, and the at least one instruction is to be executed by the processor 501 to implement the data enquiry method provided by method embodiments of the present disclosure.

In some embodiments, the display terminal 500 may optionally include: a peripheral device interface 503 and at least one peripheral device. The processor 501, the memory 502 and the peripheral device interface 503 may be connected to each other via a bus or signal line. Various peripheral devices may be connected to the peripheral device interface 503 via bus, signal line or circuit board. In specific, the peripheral device includes at least one of: a radio frequency (RF) circuit 504, a display screen 505, a camera 506, an audio circuit 507, a positioning component 508 and a power supply 509.

The peripheral device interface 503 may be configured to connect at least one peripheral device, which is related to input/output (I/O), to the processor 501 and the memory 502. In some embodiments, the processor 501, the memory 502 and the peripheral device interface 503 may be integrated on the same chip or circuit board; in some other embodiments, any one or two of the processor 501, the memory 502 and the peripheral device interface 503 may be implemented on a separate chip or circuit board, which is not limited in the embodiments.

The RF circuit 504 is configured to receive and transmit an RF signal, also known as electromagnetic signal. The RF circuit 504 communicates with a communication network and other communication device by means of electromagnetic signal. The RF circuit 504 converts an electric signal to an electromagnetic signal for transmission, or converts a received electromagnetic signal to an electric signal. Optionally, the RF circuit 504 includes: an antenna system, an RF transceiver, one or more amplifiers, a tuner, an oscillator, a digital signal processor, a codec chip set, a subscriber identity module card and the like. The RF circuit 504 may communicate with another terminal by means of at least one radio communication protocol. The radio communication protocol includes, but not limited to: World Wide Web, metropolitan area network, intranet, various generations of mobile communication networks (2G, 3G, 4G and 5G), wireless local area network and/or wireless fidelity (WiFi) network. In some embodiments, the RF circuit 504 may include a near field communication (NFC) related circuit, which is not limited by the present disclosure.

The display screen 505 is configured to display a user interface (UI). The UI may include a graphic, a text, an icon, a video or any combination thereof. If the display screen 505 is a touch display screen, the display screen 505 is further provided with a capability of capturing a touch signal on or above a surface of the display screen 505. The touch signal may be inputted as a control signal to the processor 501 for processing. In this case, the display screen 505 may further be configured to provide a virtual button and/or a virtual keyboard, also known as soft button and/or soft keyboard. In some embodiments, there may be one display screen 505, which is provided at a front panel of the display terminal 500; in some other embodiments, at least two display screens 500 may be provided, which are disposed at different surfaces of the display terminal 500 or in a folding design; in still some other embodiments, the display screen 505 may be a flexible display screen disposed on a curved or foldable surface of the display terminal 500. Even further, the display screen 505 may be designed into an irregular shape which is not rectangular, namely a special-shaped screen. The display screen 505 may be an OLED display screen.

The camera component 506 is configured to capture an image or a video. Optionally, the camera component 506 includes a front camera and a rear camera. Generally, the front camera is disposed at the front panel of the display terminal and the rear camera is disposed on the back side of the display camera. In some embodiments, at least two rear cameras are provided, which may respectively be any one of a main camera, a depth of field camera, a wide angle camera or a telephoto camera, to achieve a bokeh function by a fusion of the main camera and the depth of field camera, panorama shoot and virtual reality (VR) shoot functions by a fusion of the main camera and the wide angle camera, or other fusion shoot function. In some embodiments, the camera component 506 may further include a flashlight. The flashlight may be a mono-color-temperature flashlight or a dual-color-temperature flashlight. The dual-color-temperature flashlight refers to a combination of a warm-light flashlight and a cold-light flashlight, which may be applicable to light compensation for different color temperatures.

The audio circuit 507 may include a microphone and a speaker. The microphone is configured to capture sound waves from user and ambient sound waves, and convert the sound waves into electric signals which are inputted to the processor 501 for processing or inputted to the RF circuit 504 for voice communication. For the purpose of stereophonic sound capturing or noise reduction, multiple microphones may be provided, which are disposed at various parts of the display terminal 500. The microphone may be an array microphone or an omnidirectional microphone. The speaker is configured to convert electric signals from the processor 501 or the RF circuit 504 into sound waves. The speaker may be a traditional film speaker, or a piezoelectric ceramic speaker. If the speaker is a piezoelectric ceramic speaker, the electric signals not only may be converted into sound waves audible to human, but also may be converted into inaudible sound waves for purposes such as range finding. In some embodiments, the audio circuit 507 may further include an earphone jack.

The positioning component 508 is configured to determine the current geographic location of the display terminal 500, to enable navigation or location based service (LBS). The positioning component 508 may be based on the global position system (GPS) of United States, BeiDou Navigation Satellite System of China or Galileo system.

The power supply 509 is configured to power various components in the display terminal 500. The power supply 509 may be an AC power source, DC power source, disposable battery or rechargeable battery. If the power supply 509 includes a rechargeable battery, the rechargeable battery may be a wireline rechargeable battery or a wireless rechargeable battery. The wireline rechargeable battery is rechargeable via a wireline, and the wireless rechargeable battery is rechargeable via a wireless coil. The rechargeable battery may be configured to support a fast charge technology.

In some embodiments, the display terminal 500 further includes one or more sensors 510. The one or more sensors 510 include, but not limited to: an acceleration sensor 511, a gyroscope sensor 512, a pressure sensor 513, a fingerprint sensor 514, an optical sensor 515 and a proximity sensor 516.

The acceleration sensor 511 may detect magnitudes of accelerations on three coordinate axes of a coordinate system established with respect to the display terminal 500. For example, the acceleration sensor 511 may be configured to detect components of gravity acceleration on the three coordinate axes. According to the gravity acceleration signal detected by the acceleration sensor 511, the processor 501 may control the touch display screen 505 to display a user interface in a landscape or portrait view. The acceleration sensor 511 is also applicable to game or acquisition of user motion data.

The gyroscope sensor 512 may detect the orientation and rotation angle of the display terminal 500, and may cooperate with the acceleration sensor 511 to capture three dimensional movements to the display terminal 500 performed by a user. According to the data acquired by the gyroscope sensor 512, the processor 501 may implement the following functions: motion sensing (e.g., to change the UI in accordance with a tilt operation performed by a user), image stabilization in shooting, game control and inertial navigation.

The pressure sensor 513 may be disposed at the side frame of the display terminal 500 and/or a lower layer of the touch display screen 505. When the pressure sensor 513 is disposed at the side frame of the display terminal 500, a user's grip signal of the display terminal 500 may be detected. The processor 501 performs a left-right hand detection or quick action according to the grip signal captured by the pressure sensor 513. When the pressure sensor 513 is disposed at a lower layer of the touch display screen 505, the processor 501 implements the control of an operable control on a UI interface in accordance with a pressure applied by a user on the touch display screen 505. The operable control includes at least one of a button control, a scroll bar control, an icon control or a menu control.

The fingerprint sensor 514 is configured to capture a user's fingerprint. The processor 501 identifies the user in accordance with the fingerprint captured by the fingerprint sensor 514, or the fingerprint sensor 514 identifies the user according to the captured fingerprint. When it is identified that a user has a trustworthy identity, the processor 501 authorizes the user to perform sensitive operations, including unlocking the screen, viewing encrypted information, downloading software, making payment, modifying configuration, etc. The fingerprint sensor 514 may be disposed at the front face, the back face or the side face of the display terminal 500. When the display terminal 500 is provided with a physical button or a manufacturer's logo, the fingerprint sensor 514 may be integrated with the physical button or the manufacturer's logo.

The optical sensor 515 is configured to detect ambient light intensity. In an embodiment, the processor 501 may control the display brightness of the touch display screen 505 according to the ambient light intensity detected by the optical sensor 515. In specific, when the ambient light intensity is relatively high, the display brightness of the touch display screen 505 is increased; and when the ambient light intensity is relatively low, the display brightness of the touch display screen 505 is decreased. In another embodiment, the processor 501 may adjust the camera settings of the camera component 506 dynamically according to the ambient light intensity detected by the optical sensor 515.

The proximity sensor 516, also known as a distance sensor, is generally disposed at the front panel of the display terminal 500. The proximity sensor 516 is configured to detect a distance between a user and the front face of the display terminal 500. In an embodiment, when it is detected by the proximity sensor 516 that the distance between the user and the front face of the display terminal 500 is decreasing gradually, the processor 501 controls the touch display screen 505 to switch from a bright screen state to an always on display state; and when it is detected by the proximity sensor 516 that the distance between the user and the front face of the display terminal 500 is increasing gradually, the processor 501 controls the touch display screen 505 to switch from the always on display state to the bright screen state.

It is understood by those skilled in the art that, the display terminal 500 is not limited by the structure as shown in FIG. 12, and may include more or less components than those as illustrated, or some components may be combined, or a different component layout may be utilized.

A computer storage medium is provided in embodiments of the present disclosure. When a program stored in the storage medium is executed by a processor, the gray-level compensation method as described in any one of the method embodiments is implemented.

It is understood by those skilled in the art that, all or part of the steps for implementing the foregoing embodiments may be implemented by hardware, or may be implemented by a program which instructs related hardware. The program may be stored in a computer readable storage medium, and the aforementioned storage medium may be a read-only memory, a magnetic disk or an optical disk, etc.

The above descriptions are merely embodiments of the present disclosure, and the present disclosure is not limited thereto. Any modifications, equivalent substitutions and improvements made without departing from the conception and principle of the present disclosure shall fall within the protection scope of the present disclosure.

What is claimed is:

1. A gray-level compensation method, comprising:

acquiring an initial gray-level value of a target pixel;

determining an actual luminance offset of the target pixel based on the initial gray-level value, wherein different initial gray-level values within a specified threshold range correspond to different actual luminance offsets; and performing gray-level compensation on the target pixel based on the actual luminance offset wherein the determining the actual luminance offset of the target pixel based on the initial gray-level value comprises: determining an interpolation coefficient based on the initial gray-level value, acquiring a set luminance offset of the target pixel, and determining a product of the interpolation coefficient and the set luminance offset as the actual luminance offset and wherein:

the determining the interpolation coefficient based on the initial gray-level value comprises:

acquiring a positive correlation relationship between the initial gray-level value and the interpolation coefficient when the initial gray-level value is less than a first gray-level threshold, and determining the interpolation coefficient corresponding to the initial gray-level value based on the positive correlation relationship; or, acquiring a negative correlation relationship between the initial gray-level value and the interpolation coefficient when the initial gray-level value is greater than a second gray-level threshold, and determining the interpolation coefficient corresponding to the initial gray-level value based on the negative correlation relationship; or, determining that the interpolation coefficient is a fixed coefficient when the initial gray-level value is not less than a first gray-level threshold and not greater than a second gray-level threshold, wherein the second gray-level threshold is greater than the first gray-level threshold; or, the performing the gray-level compensation on the target pixel based on the actual luminance offset comprises:

determining an actual applied voltage of the target pixel based on a voltage compensation formula, wherein the actual applied voltage is for driving the target pixel to emit light, and the actual applied voltage is positively correlated to a displayed gray-level value of the target pixel, wherein the voltage compensation formula is $Y=a*X+\eta*b$, X denotes an initial input voltage which is a voltage corresponding to the initial gray-level value, Y denotes the actual applied voltage, a denotes a voltage gain, b denotes the set luminance offset, $\eta$ denotes the interpolation coefficient, $\eta*b$ denotes the actual luminance offset, each of a and b is a constant greater than zero, and $0\leq\eta\leq1$.

2. The gray-level compensation method according to claim 1, wherein the first gray-level threshold is 20.

3. The gray-level compensation method according to claim 1, wherein the second gray-level threshold is 235.

4. The gray-level compensation method according to claim 1, wherein the actual luminance offset is zero when the initial gray-level value is zero.

5. A gray-level compensation apparatus, comprising: a processor and a memory, wherein the memory is configured to store a program; and the processor is configured to execute the program stored in the memory, to:

acquire an initial gray-level value of a target pixel;

determine an actual luminance offset of the target pixel based on the initial gray-level value, wherein different initial gray-level values within a specified threshold range correspond to different actual luminance offsets; and perform gray-level compensation on the target pixel based on the actual luminance offset offset:

wherein the processor is configured to: determine an interpolation coefficient based on the initial gray-level value, acquire a set luminance offset of the target pixel, and determine a product of the interpolation coefficient and the set luminance offset as the actual luminance offset and wherein:

the processor is configured to:

acquire a positive correlation relationship between the initial gray-level value and the interpolation coefficient when the initial gray-level value is less than a first gray-level threshold, and determine the interpolation coefficient corresponding to the initial gray-level value based on the positive correlation relationship; or, acquire a negative correlation relationship between the initial gray-level value and the interpolation coefficient when the initial gray-level value is greater than a second gray-level threshold, and determine the interpolation coefficient corresponding to the initial gray-level value based on the negative correlation relationship; or, determine that the interpolation coefficient is a fixed coefficient when the initial gray-level value is not less than a first gray-level threshold and not greater than a second gray-level threshold, wherein the second gray-level threshold is greater than the first gray-level threshold; or, the processor is configured to:

determine an actual applied voltage of the target pixel based on a voltage compensation formula, wherein the actual applied voltage is for driving the target pixel to emit light, and the actual applied voltage is positively correlated to a displayed gray-level value of the target pixel, wherein the voltage compensation formula is $Y=a*X+\eta*b$, X denotes an initial input voltage which is a voltage corresponding to the initial gray-level value, Y denotes the actual applied voltage, a denotes a voltage gain, b denotes the set luminance offset, $\eta$ denotes the interpolation coefficient, $\eta*b$ denotes the actual luminance offset, each of a and b is a constant greater than zero, and $0\leq\eta\leq1$.

6. The gray-level compensation apparatus according to claim 5, wherein the first gray-level threshold is 20.

7. The gray-level compensation apparatus according to claim 5, wherein the second gray-level threshold is 235.

8. A display device, comprising the gray-level compensation apparatus according to claim 5.

9. The display device according to claim 8, wherein the display device is an organic light emitting diode (OLED) display device.

10. The display device according to claim 8, wherein the first gray-level threshold is 20.

11. The display device according to claim 8, wherein the second gray-level threshold is 235.

12. The display device according to claim 8, wherein the actual luminance offset is zero when the initial gray-level value is zero.

13. The gray-level compensation apparatus according to claim 5, wherein the actual luminance offset is zero when the initial gray-level value is zero.

14. A non-transitory computer readable storage medium, wherein, when a program stored in the non-transitory computer readable storage medium is executed by a processor, the following steps are implemented:

acquiring an initial gray-level value of a target pixel;

determining an actual luminance offset of the target pixel based on the initial gray-level value, wherein different initial gray-level values within a specified threshold range correspond to different actual luminance offsets; and performing gray-level compensation on the target pixel based on the actual luminance offset;

wherein the determining the actual luminance offset of the target pixel based on the initial gray-level value comprises: determining an interpolation coefficient based on the initial gray-level value, acquiring a set luminance offset of the target pixel, and determining a product of the interpolation coefficient and the set luminance offset as the actual luminance offset; and wherein:

the determining the interpolation coefficient based on the initial gray-level value comprises:

acquiring a positive correlation relationship between the initial gray-level value and the interpolation coefficient when the initial gray-level value is less than a first gray-level threshold, and determining the interpolation coefficient corresponding to the initial gray-level value based on the positive correlation relationship; or, acquiring a negative correlation relationship between the initial gray-level value and the interpolation coefficient when the initial gray-level value is greater than a second gray-level threshold, and determining the interpolation coefficient corresponding to the initial gray-level value based on the negative correlation relationship; or, determining that the interpolation coefficient is a fixed coefficient when the initial gray-level value is not less than a first gray-level threshold and not greater than a second gray-level threshold, wherein the second gray-level threshold is greater than the first gray-level threshold; or, the performing the gray-level compensation on the target pixel based on the actual luminance offset comprises:

determining an actual applied voltage of the target pixel based on a voltage compensation formula, wherein the actual applied voltage is for driving the target pixel to emit light, and the actual applied voltage is positively correlated to a displayed gray-level value of the target pixel, wherein the voltage compensation formula is $Y=a*X+\eta*b$, X denotes an initial input voltage which is a voltage corresponding to the initial gray-level value, Y denotes the actual applied voltage, a denotes a voltage gain, b denotes the set luminance offset, $\eta$ denotes the interpolation coefficient, $\eta*b$ denotes the actual luminance offset, each of a and b is a constant greater than zero, and $0\leq\eta\leq1$.

15. The non-transitory computer readable storage medium according to claim 14, wherein the first gray-level threshold is 20.

16. The non-transitory computer readable storage medium according to claim 14, wherein the second gray-level threshold is 235.

17. The non-transitory computer readable storage medium according to claim 14, wherein the actual luminance offset is zero when the initial gray-level value is zero.

* * * * *